US010910762B2

(12) United States Patent
Kosaka et al.

(10) Patent No.: US 10,910,762 B2
(45) Date of Patent: Feb. 2, 2021

(54) CONNECTOR

(71) Applicant: Sumitomo Wiring Systems, Ltd., Yokkaichi (JP)

(72) Inventors: Ryotaro Kosaka, Yokkaichi (JP); Yujiro Imai, Yokkaichi (JP); Sho Saito, Yokkaichi (JP); Masami Kawamoto, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/802,786

(22) Filed: Feb. 27, 2020

(65) Prior Publication Data

US 2020/0274288 A1 Aug. 27, 2020

(30) Foreign Application Priority Data

Feb. 27, 2019 (JP) ..... 2019-034217

(51) Int. Cl.
*H01R 13/52* (2006.01)
*H01R 13/50* (2006.01)

(52) U.S. Cl.
CPC ..... *H01R 13/5213* (2013.01); *H01R 13/501* (2013.01); *H01R 13/5202* (2013.01)

(58) Field of Classification Search
CPC ..... H01R 13/5213
See application file for complete search history.

(56) References Cited

U.S. PATENT DOCUMENTS 4,037,907 A * 7/1977 Klimek ..... H01R 13/5213 439/142
5,379,183 A * 1/1995 Okonsky ..... G06F 1/1616 16/342
2003/0019873 A1* 1/2003 Nam ..... E05D 11/1078 220/524
2004/0053525 A1 3/2004 Matsuo et al.
2010/0159720 A1* 6/2010 Wang ..... H01R 13/447 439/76.1
2013/0194595 A1 8/2013 Murata
2015/0300063 A1* 10/2015 Soma ..... E05D 7/105 16/232
2016/0111800 A1* 4/2016 Strom ..... H01R 24/78 439/682
2020/0266578 A1* 8/2020 Durse ..... B60L 53/16

FOREIGN PATENT DOCUMENTS

JP 7-29635 1/1995
JP 2004-39332 2/2004
JP 2013-155825 8/2013

* cited by examiner

*Primary Examiner* — James Harvey
(74) *Attorney, Agent, or Firm* — Gerald E. Hespos; Michael J. Porco; Matthew T. Hespos

(57) ABSTRACT

A first housing includes a wide connection surface and a bearing formed on an edge on one side along the longitudinal direction of the connection surface. A second housing includes a side surface formed to face in a direction intersecting a connecting direction of the first and second housings. A lid is displaceable about a shaft supported by the bearing portion to a closed position where the lid covers the connection surface and an open position where the lid member contacts the side surface. The lid is biased from the open position to the closed position by a biasing member. An outer shape of the lid has a long side arranged along the longitudinal direction of the connection surface and a short side intersecting the long side and shorter than the long side.

5 Claims, 9 Drawing Sheets

CONNECTOR

BACKGROUND

Field of the Invention

The disclosure relates to a connector.

Related Art

Japanese Unexamined Patent Publication No. 2004-39332 discloses a connector for towing vehicle. The connector is used in an automotive wiring harness for electrically connecting an object to be towed and a vehicle body. This connector includes a housing with an opening into which a connector of a wiring harness on the side of the object to be towed is inserted. A lid for closing the opening is mounted rotatably on the upper end of the opening of the housing. The lid has a rotary shaft on an end part and is biased in a direction to close the opening by a winding spring wound on the outer periphery of the rotary shaft.

Japanese Unexamined Patent Publication No. 2013-155825 discloses a technique for closing an opening of a socket body by a lid port. Japanese Unexamined Patent Publication No. H07-29635 discloses a lid provided on a vehicle-side connector of an electric vehicle.

A projecting direction of the opened lid of the connector for towing a vehicle disclosed in JP 2004-39332 often is the same as a routing direction of the wiring harness on the side of the object to be towed. Thus, even if the opened lid projects a large distance from the rotary shaft, the opened lid can be arranged in a routing space of the wiring harness on the side of the object to be towed without trouble. However, if the projecting direction of the lid does not coincide with a routing direction of a mating wiring harness and a routing space of the mating wiring harness is limited, the opened lid may not be accommodated properly in the routing space.

Accordingly, it is aimed to provide a connector excellent in space efficiency.

SUMMARY

The present disclosure is directed to a connector with a first housing and a second housing connectable to each other. A connection surface is formed at a position of the first housing facing the second housing and is long in a longitudinal direction. A bearing is formed on an edge on one side along the longitudinal direction of the connection surface in the first housing. A side surface is formed in the second housing to face in a direction intersecting a connecting direction of the first housing and the second housing. A lid is displaceable about a shaft supported by the bearing to a closed position where the lid covers the connection surface and an open position where the lid contacts the side surface when the first housing and the second housing are connected. A biasing member biases the lid from the open position to the closed position. The lid has a long side arranged along the longitudinal direction of the connection surface and a short side intersecting the long side and shorter than the long side.

The lid may have a long side arranged along the longitudinal direction of the connection surface and a short side intersecting the long side and shorter than the long side. When the lid contacts the side surface of the second housing at the open position, the short side of the lid projects a little toward a side where the second housing is located. Thus, the connector is applicable when there is a space limitation on the side where the second housing is located. Further, the biasing member can bring the lid automatically to the closed position when the second housing is separated from the first housing.

A sealing member may be disposed in the lid for sealing the connection surface at the closed position, and the side surface of the second housing may include an outer peripheral wall surrounding the sealing member when the lid is at the open position. The outer peripheral wall prevents damage to the sealing member when the lid is open. As a result, the liquid-tightness of the sealing member between the closed lid and the connection surface is ensured.

The second housing may include a second housing body and a wire cover to be mounted on the second housing body. The side surface and the outer peripheral wall may be provided on the wire cover. According to this configuration, the outer peripheral wall need not be provided on the second housing body and the structure of the second housing body can be simplified.

The lid may include a lid-side lock, and a side surface of the second housing may include a housing-side lock for keeping the lid at the open position by contact with the lid-side lock. Since the lid is kept at the open position by the contact of the housing-side lock with the lid-side lock, the lid will not separate from the side surface under vibration.

The connector of this disclosure provides with excellent space efficiency.

DETAILED DESCRIPTION

Figure 1:
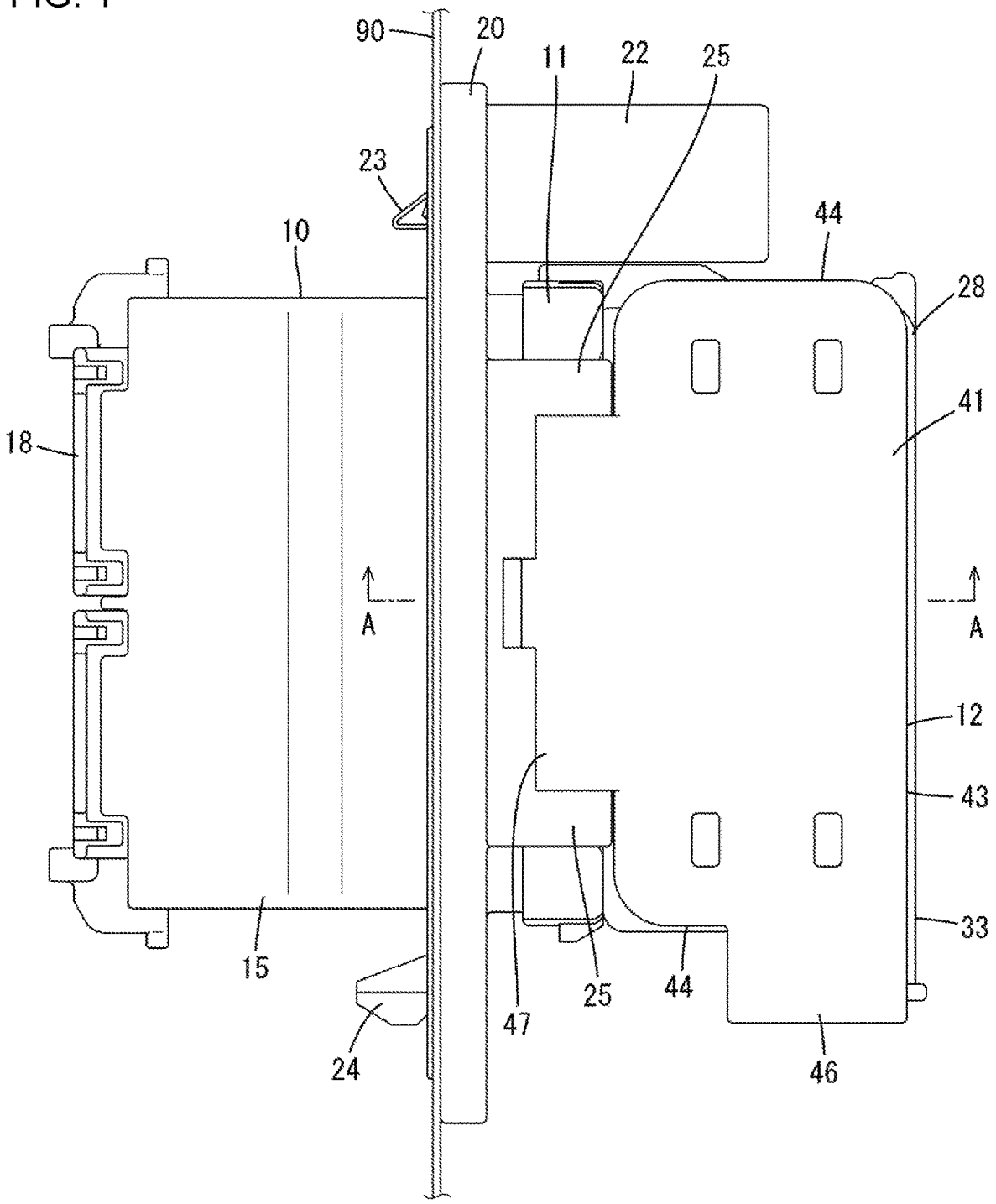
FIG. 1 is a side view showing a state where a connector according to an embodiment is mounted on a panel.

A specific example of the connector of this disclosure is described below with reference to the drawings. Note that the invention is not limited to these illustrations and is intended to be represented by claims and include all changes in the scope of claims and in the meaning and scope of equivalents.

A connector according to an embodiment is mounted on a panel 90 such as a door panel of an unillustrated automotive vehicle. For example, a front surface side (left side of FIG. 1) of the panel 90 is a vehicle body side, and a rear surface side (right side of FIG. 1) of the panel 90 is a door side. The connector includes a first housing 10 and a second housing 11 connectable to each other. A lid 12 is supported on the first housing 10, and a biasing member 14 and a sealing member 13 (see FIG. 8) are disposed in the lid 12. The first housing 10, the second housing 11 and the lid 12 are made of synthetic resin. The biasing member 14 is a winding spring (torsional coil spring) made of metal. The sealing member 13 is made of rubber, such as silicon rubber.

Note that, in the following description of the first housing 10 and the second housing 11, surfaces facing each other at the start of connection of the first housing 10 and the second housing 11 are referred to as front ends concerning a front-rear direction.

<First Housing 10>

Figure 2:
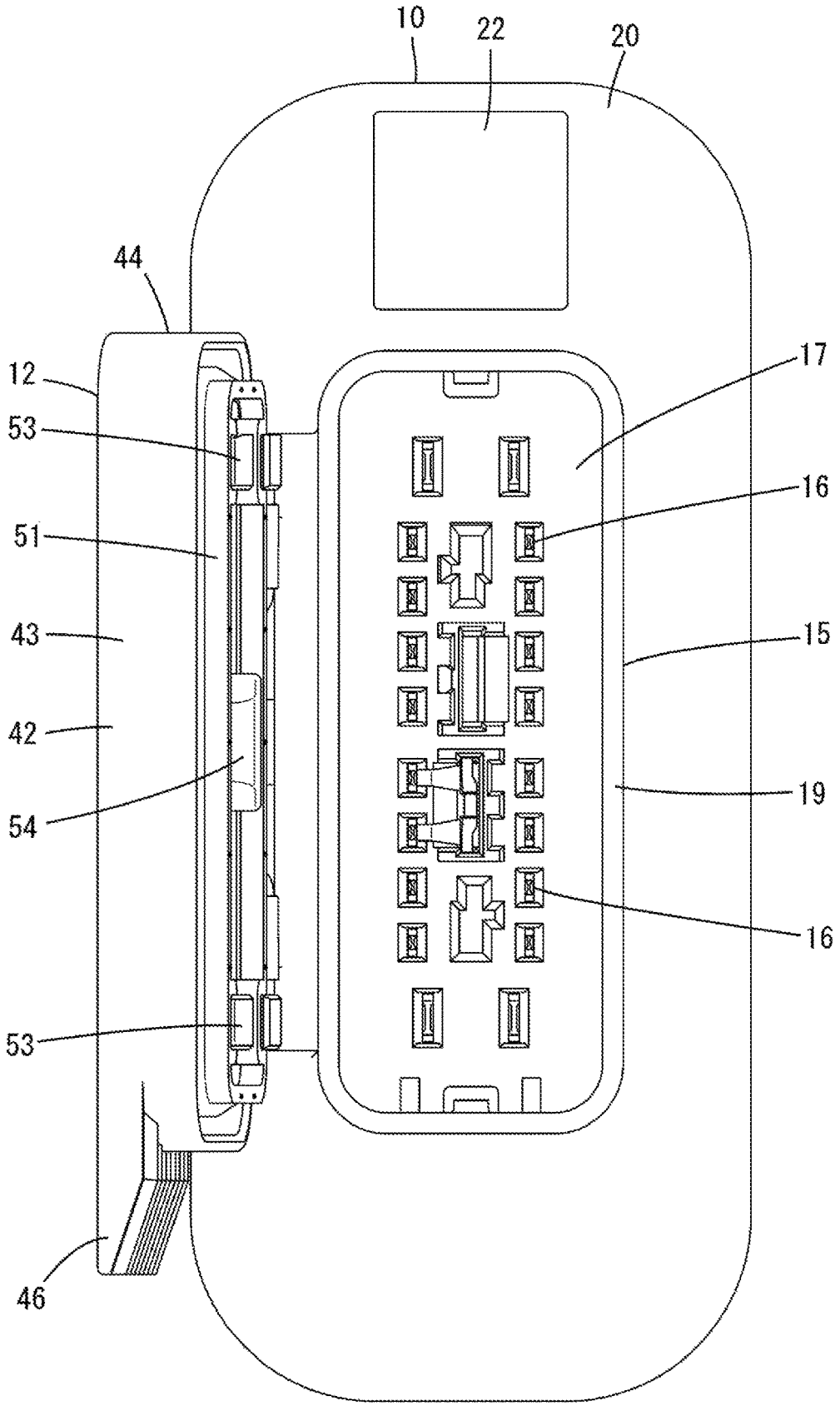
FIG. 2 is a front view of a first housing with a lid supported at an open position.

As shown in FIG. 2, the first housing 10 includes a first housing body 15 that is arranged through a mounting hole 91 (see FIG. 9) of the panel 90. The first housing body 15 is formed to conform to an opening shape of the mounting hole 91 such that a vertical direction (height direction) is a longitudinal direction in a front view. First terminal fittings 16 are mounted into the first housing body 15. Each first terminal fitting 16 projects forward from the front surface of the first housing body 15. The front surface of the first housing body 15 is a connection surface 17 facing the second housing 11 at the start of connection.

The connection surface 17 has a rectangular outer shape long in the vertical direction and has four rounded corners in a front view. Although not shown, each first terminal fitting 16 also projects rearward from the rear surface of the first housing body 15. As shown in FIG. 1, the first housing body 15 is fit to another housing 18 (vehicle body side housing) from behind. Each first terminal fitting 16 is connected electrically to an unillustrated other terminal fitting mounted in the other housing 18. Further, each first terminal fitting 16 is connected, in a front part, to an unillustrated second terminal fitting mounted in the second housing 11. That is, the first housing body 15 functions as a relay housing.

As shown in FIG. 2, the first housing body 15 includes a rectangular tubular receptacle 19 long in the vertical direction and projecting forward from the outer edge of the connection surface 17.

Figure 9:
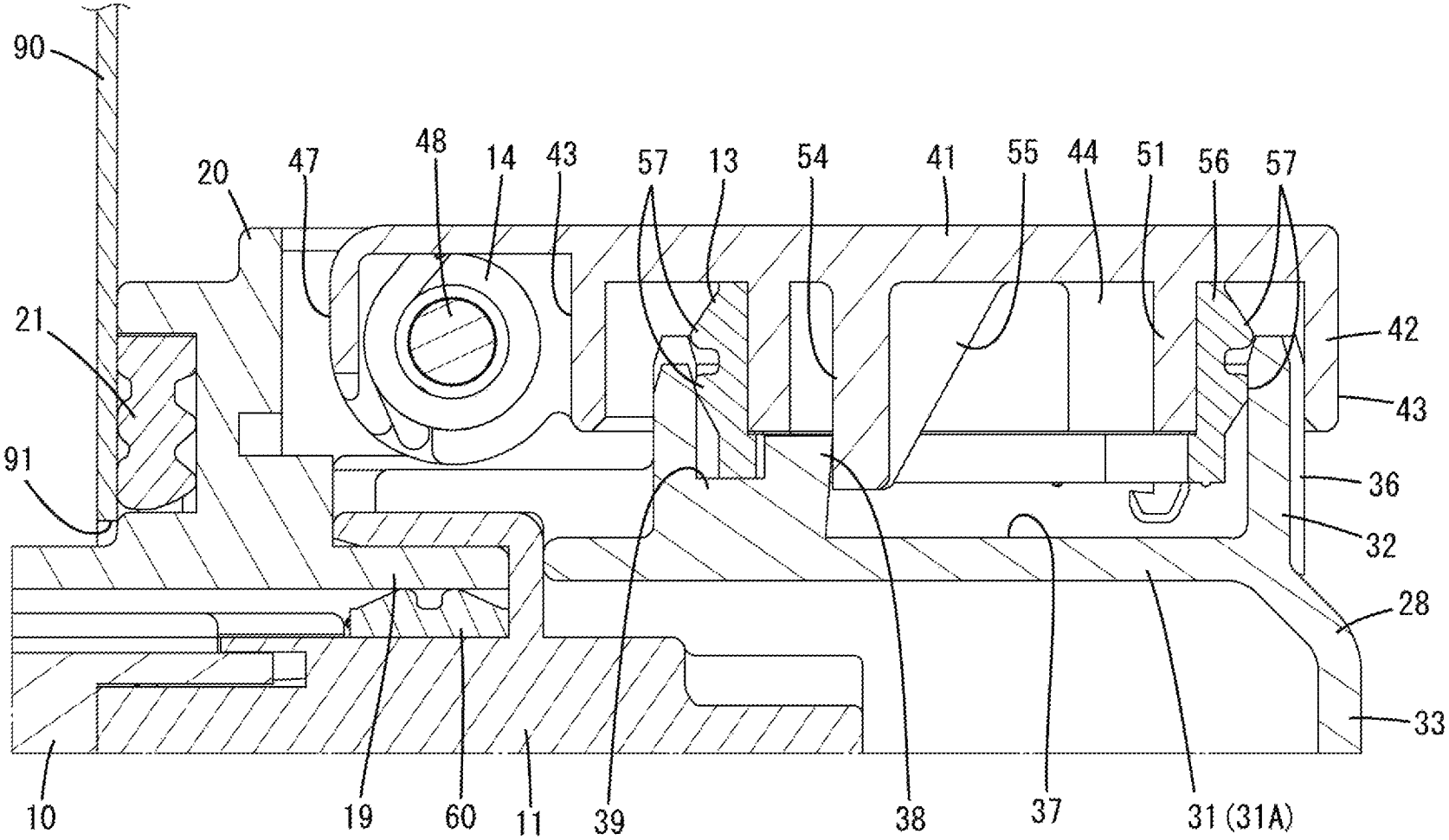
FIG. 9 is a section along A-A of FIG. 1.

A flange 20 protrudes out from the receptacle 19 of the first housing 10. As shown in FIG. 1, the flange 20 faces an opening edge part of the mounting hole 91 on the rear surface of the panel 90. As shown in FIG. 9, a sealing ring 21 is sandwiched between the front surface of the panel 90 and the flange 20.

As shown in FIG. 1, a mounting portion 22 projects forward from the flange 20 at a position above the first housing body 15. A lock 23 made of metal is mounted into the mounting portion 22 from behind, and a tip of the lock 23 projects rearward from the flange portion 20. The flange 20 includes an arm 24 projecting rearward below the first housing body 15. The tip of the lock 23 and the arm 24 are hooked to the front surface of the panel 90 with the first and second housings 10, 11 connected to mount the connector on the panel 90.

Figure 3:
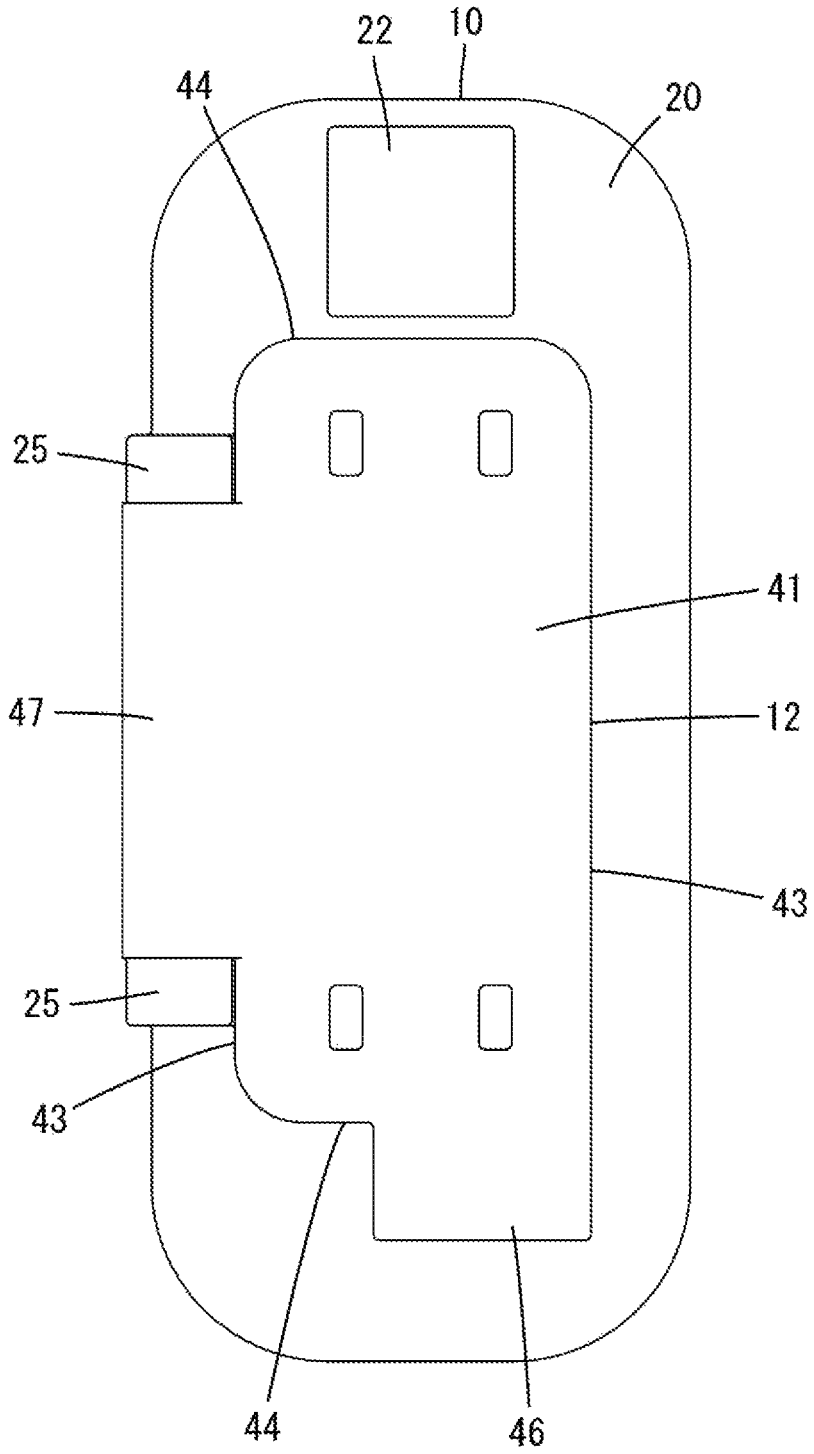
FIG. 3 is a front view of the first housing with the lid supported at a closed portion.

As shown in FIG. 3, the first housing 10 includes two bearings 25 on one side surface along the vertical direction (longitudinal direction) in the receptacle 19. The bearings 25 are arranged on the one side surface of the receptacle 19 while being vertically spaced apart. The bearings 25 include unillustrated bearing holes in surfaces facing each other. The bearings 25 rotatably support the lid 12 via a shaft 48 to be described later.

<Second Housing 11>

Figure 4:
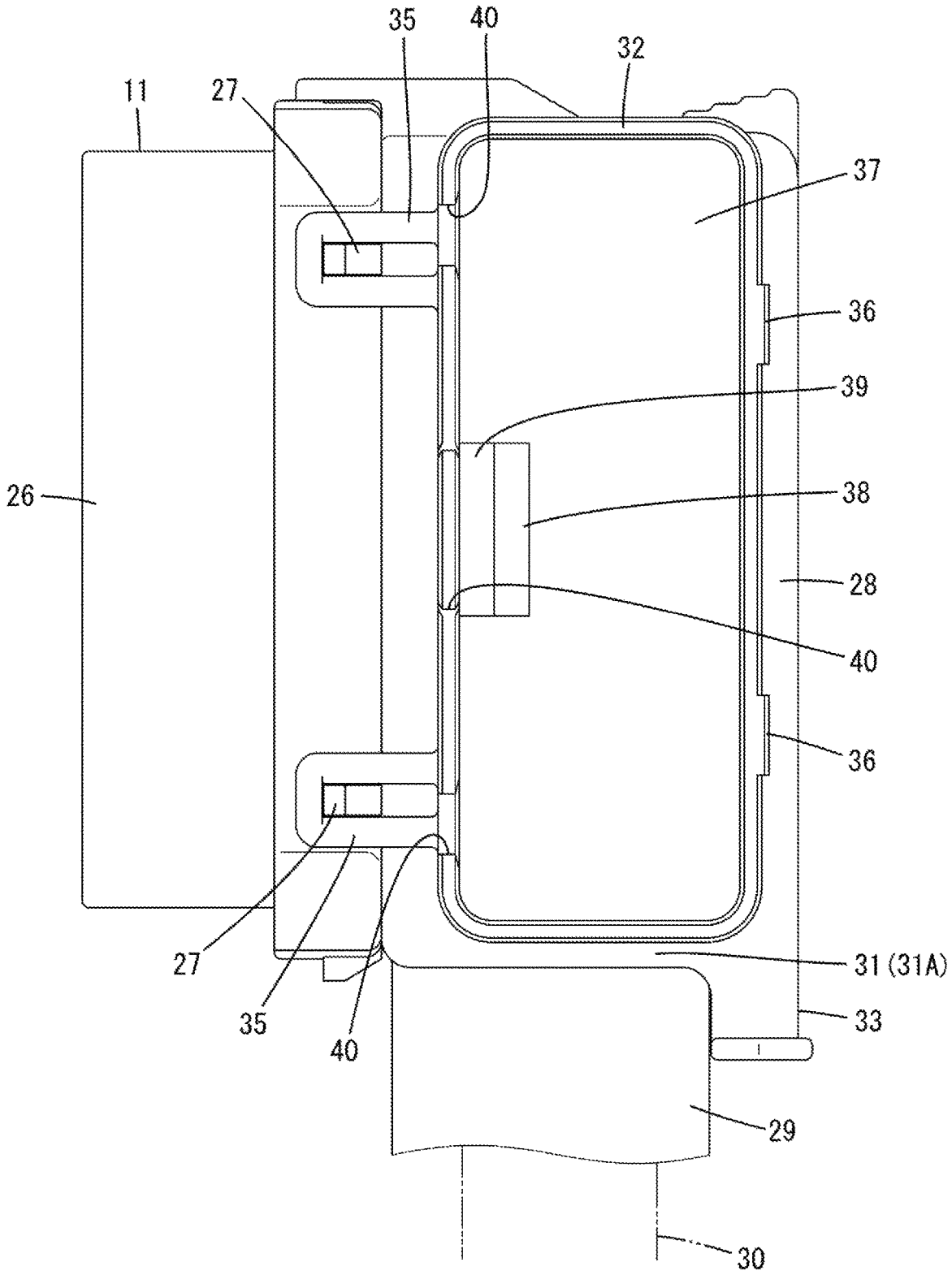
FIG. 4 is a side view of a second housing including a side surface of a grommet cover.

The second housing 11 is on a door side and includes, as shown in FIG. 4, a second housing body 26. The second housing 11 is fit into the receptacle 19 of the first housing 10. As shown in FIG. 9, a housing sealing member 60 is mounted on the outer peripheral surface of the second housing 11. The housing sealing member 60 is made of rubber, such as silicon rubber, and is sandwiched between the receptacle 19 and the second housing in a liquid-tight manner. Unillustrated second terminal fittings are accommodated into the second housing body 26. The second housing body 26 includes lock projections 27 on an outer surface.

As shown in FIG. 4, the second housing 11 includes a grommet cover 28 to be mounted on a rear part of the second housing body 26. Further, a grommet 29 made of rubber, such as silicon rubber, is mounted on the rear part of the second housing body 26. The grommet 29 is boot-shaped and covers a wire group 30 pulled out from the rear surface of the second housing 11. Note that the grommet cover 28 covers the wire group 30 via the grommet 29.

Figure 5:
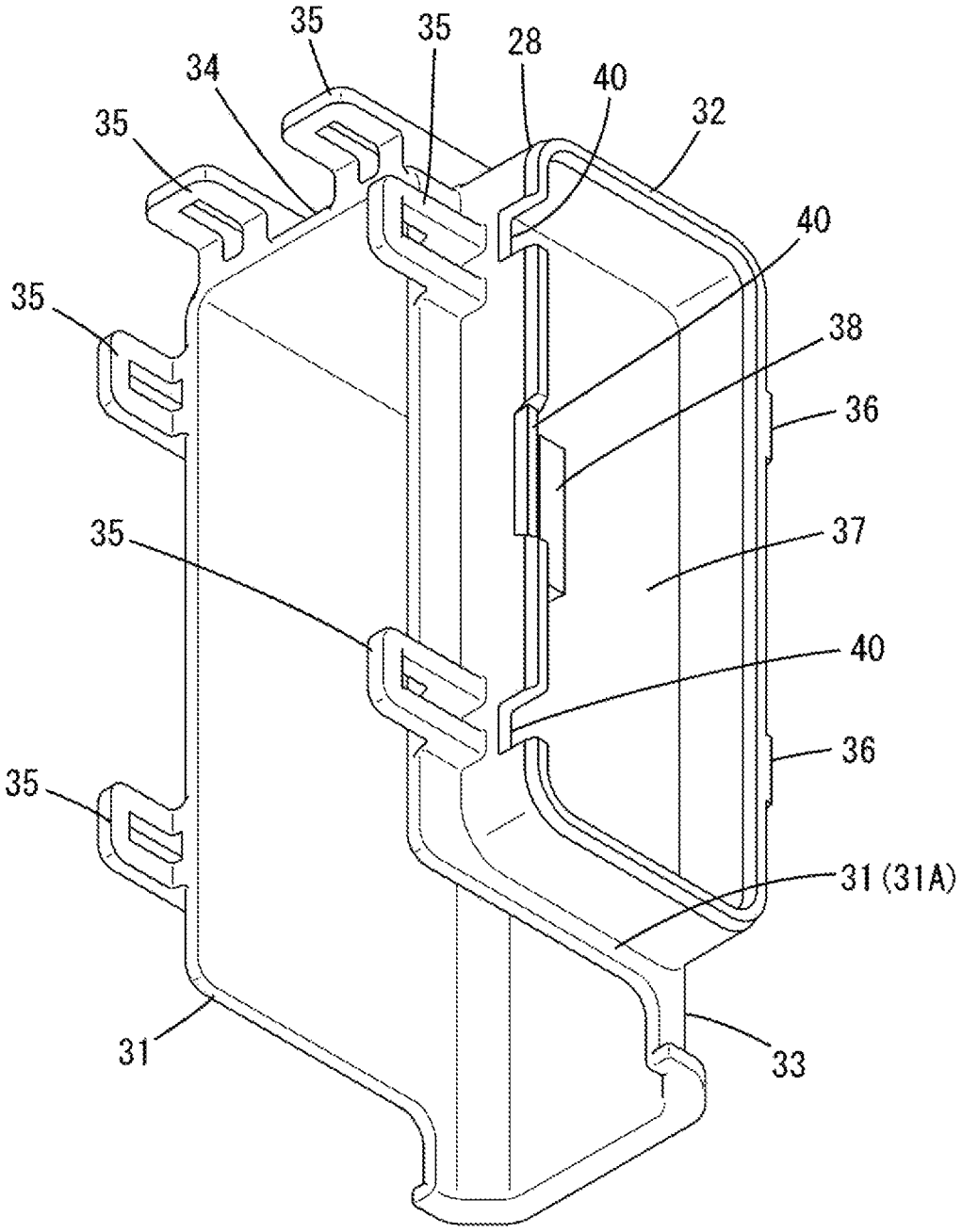
FIG. 5 is a perspective view of the grommet cover.

As shown in FIG. 5, the grommet cover 28 is cap-like and includes two side walls 31 facing each other in a lateral direction (width direction). The side walls 31 are arranged to face in a direction perpendicular to a connecting direction of the first housing 10 and the second housing 11. Further, the side walls 31 have a rectangular outer shape having a longitudinal direction aligned with the vertical direction (height direction) in a side view. The grommet cover 28 includes a back wall 33 connecting the rear ends of the both side walls 31 and an upper wall 34 connecting the upper ends of both side surface walls 31. The back wall 33 includes a part projecting farther down than the lower ends of the side walls 31, as shown in FIG. 4. The wire group 30 is drawn out downward (direction intersecting the connecting direction) along the back wall 33.

The side walls 31 and the upper wall 34 include locks 35 projecting forward on front end parts, as shown in FIG. 5. The locks 27 are resiliently fit into the respective lock pieces 35, as shown in FIG. 4, to hold the grommet cover 28 on the second housing 11. The grommet 29 is sandwiched between the grommet cover 28 and the second housing 11.

The first side wall 31A has an outer peripheral wall 32 projecting laterally (forward of the plane of FIG. 4). The outer peripheral wall 32 has a rectangular annular shape with a longitudinal direction aligned with the vertical direction in a side view, and is arranged over the entire periphery on an outer peripheral side of the first side wall 31A. The outer peripheral wall 32 includes contacts 36 in the form of flat bases at positions vertically spaced apart on the rear surface of a rear part. End surfaces of the contacts 36 are flat along the vertical direction.

The first side wall 31A has a flat surface 37 along the vertical direction and the front-rear direction inside the peripheral wall 32. The first side wall 31A includes a housing-side lock 38 projecting laterally from the flat surface 37 inside the outer peripheral wall 32. The housing-side lock 38 is at a position near a front part of the outer peripheral wall 32 in a vertically central part of the first side wall 31A. The housing-side lock 38 is between the contact portions 36 in the vertical direction and is in the form of a rib extending in the vertical direction. As shown in FIG. 9, the rear surface of the housing-side lock 38 is inclined rearward in an overhanging manner from the flat surface 27 toward a tip. The housing-side lock 38 and the front part of the outer peripheral wall 32 are coupled by a link 39 shorter in height than the housing-side lock 38. An end part of the sealing member 13 is inserted into an inner space defined by the link 39, the housing-side lock 38 and the outer peripheral wall 32. As shown in FIG. 4, the front part of the outer peripheral wall 32 includes recesses 40 formed by cutting a tip part (tip part in a projecting direction) at positions facing the housing-side lock 38 and the respective lock pieces 35.

<Lid 12>

Figure 7:
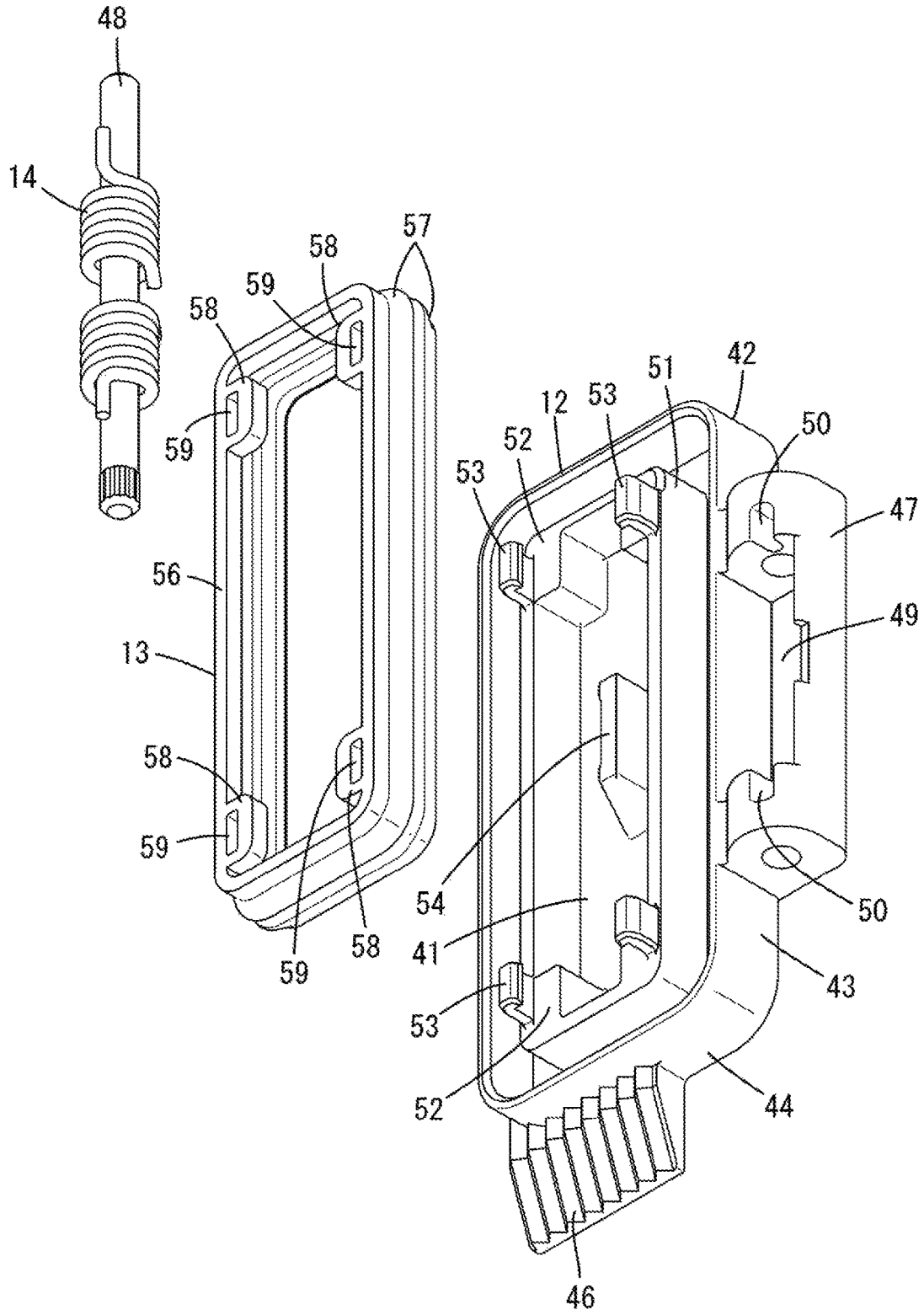
FIG. 7 is an exploded perspective view of the lid, a seal and a biasing member.

As shown in FIG. 7, the lid 12 is cap-shaped and includes a lid body 41 in the form of a flat plate along the vertical direction. Note that, in the following description of the lid 12, a "front surface" is a surface of the lid body 41 facing toward the connection surface 17 when the lid 12 is at a closed position to be described later.

Figure 6:
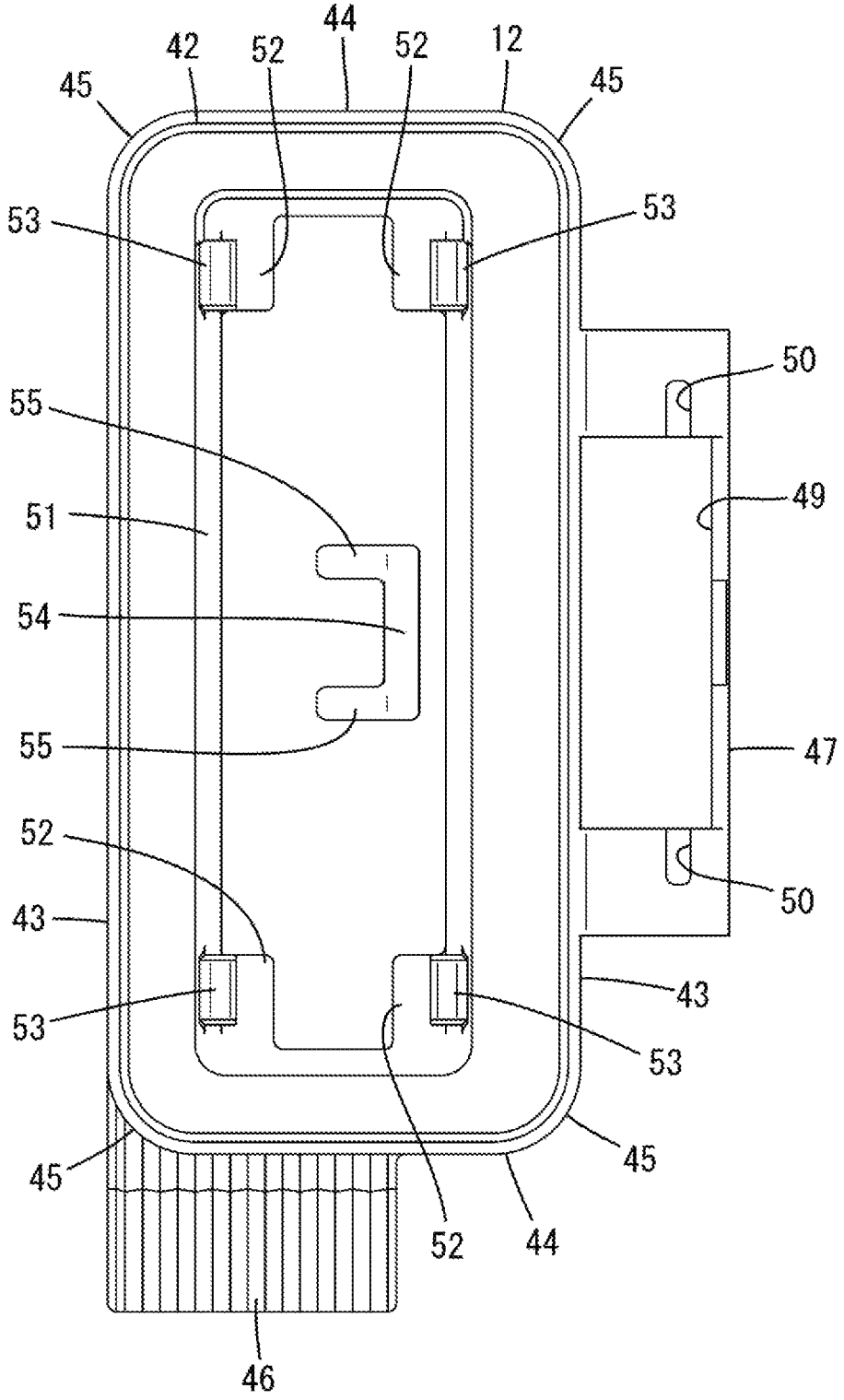
FIG. 6 is a front view of the lid.

The lid 12 includes an outer tube 42 projecting forward (toward a side forward of the plane of FIG. 6) from the outer peripheral edge of the lid body 41. As shown in FIG. 6, the outer tube 42 has a rectangular annular shape when viewed from the front and defines the outer shape of the lid 12. Specifically, when viewed from the front, the outer tube 42 has two long sides 43 extending along the vertical direction, short sides 44 extending along the lateral direction (width direction) and shorter than the long sides 43, and curved corners 45 connecting the short sides 44 and the both long sides 43 at four corners.

The lid 12 includes a projecting piece 46 projecting down from the lower short side 44. The projecting piece 46 is in the form of a finger-holdable plate.

The lid 12 includes a holding portion 47 extending in the vertical direction along the right long side 43 of FIG. 6.

Figure 8:
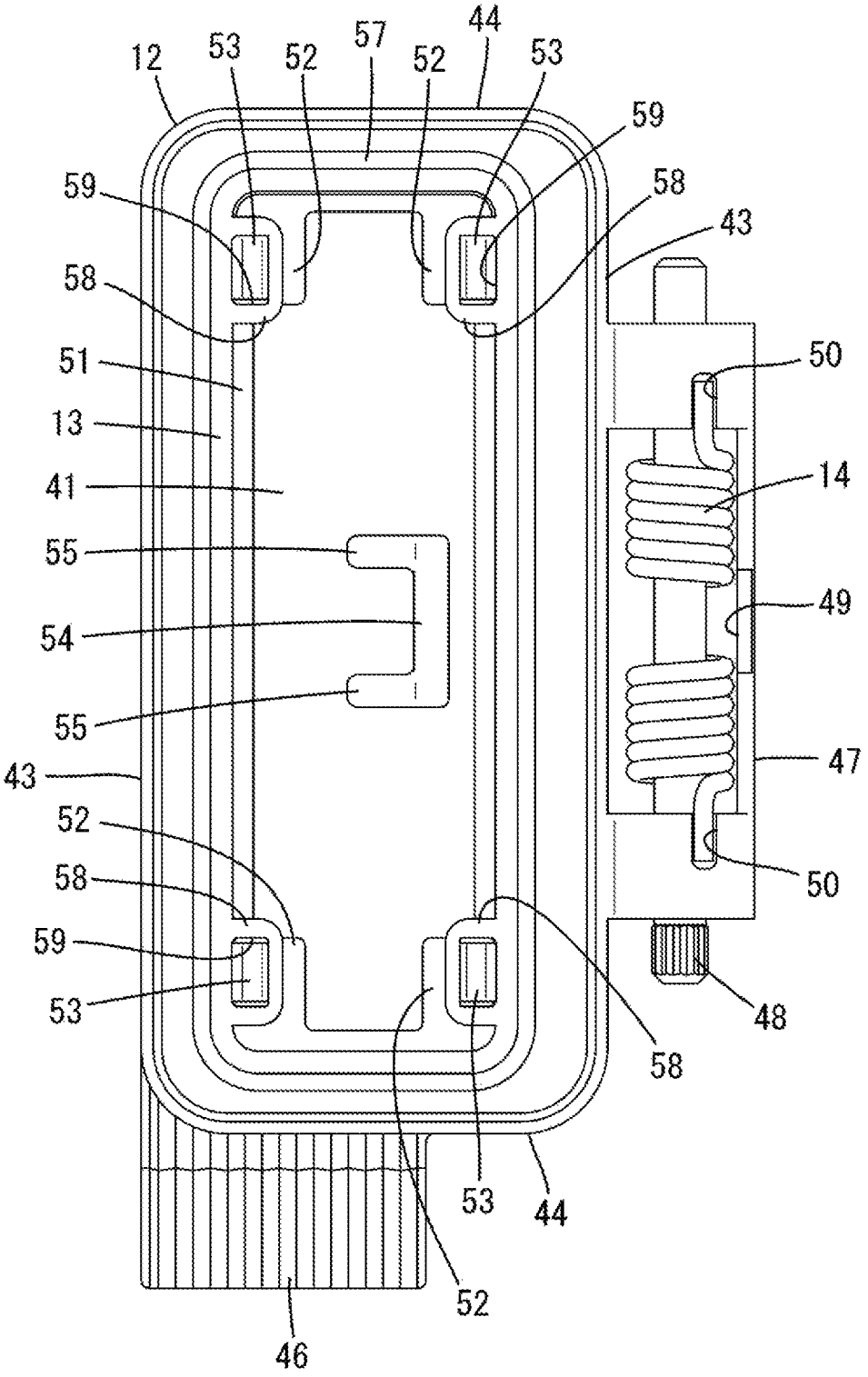
FIG. 8 is a front view of the lid with the seal and the biasing member.

A winding spring as the biasing member 14 has the shaft 48 serving as a guiding rod inserted in a central part, as shown in FIG. 7. As shown in FIG. 8, the holding portion 47 holds the shaft 48 and is coupled integrally to the one long side 43. As shown in FIG. 3, the holding portion 47 and the lid body 41 are connected without any step on a rear surface of the lid 12.

As shown in FIG. 8, the holding portion 47 includes a recess 49 for accommodating a body part of the biasing member 14 in a front surface. The holding portion 47 includes grooves 50 respectively communicating with the upper and lower ends of the recess 49 in the front surface. The grooves 50 extend in the vertical direction and upper and lower ends of the biasing member 14 are inserted therein. Upper and lower ends of the shaft 48 are arranged to project from the holding portion 47. The upper and lower ends of the shaft 48 are inserted and supported in the bearing holes of the both bearings 25 on the first housing 10.

The lid 12 is displaced rotationally between an open position (see FIG. 3) and the closed position (see FIGS. 1 and 2) about the shaft 48 supported by both bearings 25. When the lid 12 is at the open position, the lid body 41 is arranged to cover the one side surface portion 31A, as shown in FIG. 9. When the lid 12 is at the closed position, the lid body 41 is arranged to cover the connection surface portion 17. A torsional force accumulates in the biasing member 14 while the lid 12 is rotated from the closed position toward the open position. Thus, the lid 12 is biased toward the closed position by the biasing member 14. Note that a worker can bring the lid 12 from the closed position to the open position against a biasing force of the biasing member 14 while holding the projecting piece 46 with fingers.

As shown in FIGS. 6 and 7, the lid 12 includes an inner tube 51 projecting forward from the front surface of the lid body 41 inside the outer tube 42. The inner tube 51 has a rectangular annular shape when viewed from the front and is constituted by walls parallel to the long sides 43, the short sides 44 and the corners 45. The sealing member 13 closely contacts the outer peripheral surface of the inner tube 51, as shown in FIG. 8. The inner tube 51 includes thick portions 52 on four corners when viewed from the front. The inner tube 51 includes projections 53 projecting forward from end surfaces of the thick portions 52. As shown in FIG. 7, tips of the projections 53 are formed into claws projecting inward.

The lid 12 includes a lid-side lock 54 projecting forward from the front surface of the lid body 41 inside the inner tube 51. The lid-side lock 54 is a plate extending in the vertical direction parallel to the long sides 43 at a position near the holding portion 47 on the front surface of the lid body 41, as shown in FIG. 6. As shown in FIG. 9, the plate surface facing toward the holding portion 47 can contact the housing-side lock 38. The plate surface of the lid-side lock 54 facing toward a side opposite to the holding portion 47 is coupled to couplings 55 in the form of triangular ribs extending between this plate surface and the front surface of the lid body 41. Two of the couplings 55 extend in the width direction and are coupled to upper and lower end parts of the lid-side lock 54. The lid-side lock 54 is reinforced by the respective couplings 55 and has a predetermined rigidity.

<Sealing Member 13>

As shown in FIG. 7, the sealing member 13 includes a sealing body 56 having a rectangular annular shape long in the vertical direction when viewed from the front (side forward of the plane of FIG. 7). The sealing body 56 is fit and held on the outer peripheral surface of the inner tube 51 and has a predetermined thickness in the front-rear direction. The sealing body 56 includes two sealing lips 57 arranged one after another in the front-rear direction on the outer peripheral surface of the sealing body 56. Each sealing lip 57 closely contacts the inner peripheral surface of the receptacle 19 when the lid 12 is at the closed position to seal between the lid 12 and the connection surface 17 in a liquid-tight manner.

Fixing portions 58 protrude inward to face each other in parts near four corners in a front part of the sealing body 56. A hole 59 penetrates a central part of each fixing portion 58 in the front-rear direction. As shown in FIG. 8, the fixing portions 58 are supported on end surfaces of the thick portions 52 of the inner tube 51. The projections 53 are inserted into the holes 59 of the fixing portions 58 so that tips of the projections 53 contact the front surfaces of the fixing portions 58. In this way, the sealing member 13 is retained and held in the lid 12 and will not come out forward.

<Functions of Lid Member 12>

The connector is mounted on the panel 90 with the first and second housings 10, 11 connected and the first housing 10 passed through the mounting hole 91 of the panel 90.

When the first and second housings 10, 11 are connected, the connection surface 17 of the first housing 10 is arranged to face the second housing 11. At this time, the lid 12 is at the open position and, as shown in FIG. 9, the plate surface of the lid body 41 is arranged to face the one side surface 31A of the second housing 11. Specifically, the plate surface of the lid body 41 is arranged parallel to and at a distance from the flat surface 37. The lid body 41 is arranged to cover the entire flat surface 37.

When the lid 12 is at the open position, the outer tube 42 is fit externally on the outer peripheral wall 32. The short sides 44 of the outer tube 42 are arranged along a short direction (connecting direction). As shown in FIG. 1, an end part of the lid 12 in the short direction (end part opposite to the holding portion 47) is retracted forward of the back wall 33.

As shown in FIG. 9, the long side 43 on the end part of the lid 12 in the short direction is arranged along the rear surface of the outer peripheral wall 32 and in contact with the end surfaces of the contacts 36. The lid-side lock 54 is tightly in contact with a tip side of the rear surface of the housing-side lock 38.

The sealing member 13 is sandwiched between the inner tube 51 and the outer peripheral wall 32. Parts of the sealing lips 57 are lightly in contact with the inner peripheral surface of the outer peripheral wall 32. The sealing member 13 has an outer peripheral side surrounded by the outer peripheral wall 32 and the outer tube 42. Thus, the sealing member 13 is sealed off without being exposed between the lid 12 and the one side surface 31A. Note that the sealing member 13 is in contact with an end surface of the linking portion 39 while being spaced apart from the flat surface 37.

The lid 12 is pulled temporarily up in a direction away from the one side surface 31A against a biasing force of the biasing member 14 when reaching the closed position from the open position. Subsequently, a connected state of the first and second housings 10, 11 is released and the first housing 10 is separated from the second housing 11. Thereafter, the lid 12 is separated from the worker's hand and automatically brought to the closed position by the biasing force of the biasing member 14.

When the lid 12 is at the closed position, the lid body 41 is arranged to cover the entire connection surface 17 (see FIGS. 2 and 3). The outer tube 42 is fit externally to the receptacle 19. The sealing member 13 is sandwiched between the inner tube 51 and the receptacle 19 in a liquid-tight manner. In this way, water cannot intrude from the side of the lid 12 to the side of the connection surface 17.

The rear surface of the panel 90 is the door side and a large routing space for the wire group 30 cannot be secured on the rear surface of the panel 90. In contrast, the lid 12 at the open position comes into contact with the one side surface 31A of the second housing 11 in a state where the short sides 44 project rearward. Thus, the lid 12 at the open position does not project a large distance toward the rear surface of the panel 90. Therefore, the lid 12 at the open position can be accommodated on the rear surface of the panel 90 with good space efficiency.

Further, the lid 12 can be brought automatically to the closed position by being biased by the biasing member 14. Thus, a special operation of bringing the lid 12 to the closed position is unnecessary. The lid 12 at the closed position covers the connection surface portion 17 of the first housing 10 and further is sealed by the sealing member 13.

The sealing member 12 is surrounded by the outer peripheral wall 32 of the second housing 11 when the lid 12 is at the open position. Thus, external matter cannot interfere with the sealing member 13, and proper sealing performance of the sealing member 13 is achieved. Since the outer peripheral wall 32 is provided on the grommet cover 28 of the second housing 11, a degree of molding freedom is high and a predetermined rigidity can be ensured.

When the lid 12 is at the open position, the lid-side lock 54 and the housing-side lock 38 are tightly in contact with each other inside the sealing member 13. Thus, even if the connector is placed under vibration, inadvertent separation of the lid 12 from the one side surface 31A is prevented.

The embodiment disclosed above should be considered illustrative in all aspects, rather than restrictive.

For example, although the connector is mounted on the panel 90 in the above embodiment, a connector may not be mounted on the panel 90 as another embodiment.

Although the sealing member 13 is separated from the connection surface portion 17 when the lid 12 is at the closed position in the above embodiment, the sealing member 13 may be arranged in contact with the connection surface portion 17 as another embodiment.

Although the sealing member 13 is mounted in the lid 12 in the above embodiment, the sealing member 13 may not be mounted in the lid 12 as another embodiment. For example, the connector may be a non-waterproof connector having no sealing member 13. In this case, the lid 12 at the closed position may function such that external matters do not interfere with the connection surface portion 17 of the first housing 10.

Although the long sides 43 and the short sides 44 are straight in the above embodiment, the long sides 43 and the short sides 44 may be curved or bent as another embodiment. The long sides 43 and the short sides 44 only have to extend in the longitudinal direction and the short direction as a whole, respectively.

Although the grommet case 28 is configured to cover the wire group 30 via the grommet 29 in the above embodiment, a wire cover may be configured to cover the wire group 30 directly without the grommet 29.

LIST OF REFERENCE SIGNS

10 . . . first housing
11 . . . second housing
12 . . . lid
13 . . . sealing member
14 . . . biasing member
15 . . . first housing body
16 . . . first terminal fitting
17 . . . connection surface
18 . . . other housing
19 . . . receptacle
20 . . . flange
21 . . . sealing ring
22 . . . mounting portion
23 . . . lock
24 . . . arm
25 . . . bearing
26 . . . second housing body
27 . . . lock projection
28 . . . grommet cover (wire cover)
29 . . . grommet
30 . . . wire group
31 . . . side surface
31A . . . one side surface
32 . . . outer peripheral wall
33 . . . back wall
34 . . . upper wall
35 . . . lock piece
36 . . . contact
37 . . . flat surface
38 . . . housing-side lock
39 . . . linking portion
40 . . . recess
41 . . . lid body
42 . . . outer tube
43 . . . long side
44 . . . short side
45 . . . corner
46 . . . projecting piece
47 . . . holding portion
48 . . . shaft
49 . . . recess
50 . . . groove
51 . . . inner tube
52 . . . thick portion
53 . . . projection
54 . . . lid-side lock
55 . . . coupling
56 . . . sealing body
57 . . . sealing lip
58 . . . fixing portion
59 . . . hole

60 . . . housing sealing member
90 . . . panel
91 . . . mounting hole

What is claimed is:

1. A connector, comprising:

a first housing and a second housing connectable to each other;

a connection surface formed to be long in a longitudinal direction at a position of the first housing facing the second housing;

a bearing formed on an edge on one side along the longitudinal direction of the connection surface in the first housing;

a side surface formed in the second housing to face in a direction intersecting a connecting direction of the first housing and the second housing;

a lid displaceable about a shaft supported by the bearing to a closed position where the lid covers the connection surface and an open position where the lid contacts the side surface when the first housing and the second housing are connected; and a biasing member for biasing the lid from the open position to the closed position, an outer shape of the lid having a long side arranged along the longitudinal direction of the connection surface and a short side intersecting the long side and shorter than the long side.

2. The connector of claim 1, wherein:

a sealing member disposed in the lid and sealing the connection surface at the closed position, and the second housing includes, on the side surface, an outer peripheral wall surrounding the sealing member when the lid is at the open position.

3. The connector of claim 2, wherein the second housing includes a second housing body and a wire cover to be mounted on the second housing body, and the side surface and the outer peripheral wall are provided on the wire cover.

4. The connector of claim 3, wherein:

the lid includes a lid-side lock; and the second housing includes, on the side surface, a housing-side lock for keeping the lid at the open position by contact with the lid-side lock.

5. The connector of claim 1, wherein:

the lid includes a lid-side lock; and the second housing includes, on the side surface, a housing-side lock for keeping the lid at the open position by contact with the lid-side lock.

* * * * *